US005619091A

United States Patent [19]

Anderson et al.

[11] Patent Number: 5,619,091

[45] Date of Patent: Apr. 8, 1997

[54] DIAMOND FILMS TREATED WITH ALKALI-HALIDES

[75] Inventors: David F. Anderson, Batavia; Simon W. Kwan, Geneva, both of Ill.

[73] Assignee: Universities Research Association, Inc., Washington, D.C.

[21] Appl. No.: 317,211

[22] Filed: Oct. 3, 1994

[51] Int. Cl.[6] ..... H01J 43/00

[52] U.S. Cl. ..... 313/103 R; 313/533; 313/104

[58] Field of Search ..... 313/103 R, 533, 313/103 CM, 104

[56] References Cited

U.S. PATENT DOCUMENTS

Re. 28,751 3/1976 Ball .
3,898,460 8/1975 Noakes et al. .
4,347,458 8/1982 Tomasett et al. ..... 313/103 R
5,256,888 10/1993 Kane .
5,284,525 2/1994 Saito et al. .

OTHER PUBLICATIONS

"Schotty barrier height and negative electron affinity of titanium on (111) diamond", *J. Vac. Sci. Technol.* B 10(4), van der Weide et al., Jul. 1992.

*Primary Examiner*—Sandra L. O'Shea
*Assistant Examiner*—Vip Patel
*Attorney, Agent, or Firm*—McAndrews, Held & Malloy, Ltd.

[57] ABSTRACT

A secondary electron emitter is provided and includes a substrate with a diamond film, the diamond film is treated or coated with an alkali-halide.

11 Claims, 3 Drawing Sheets

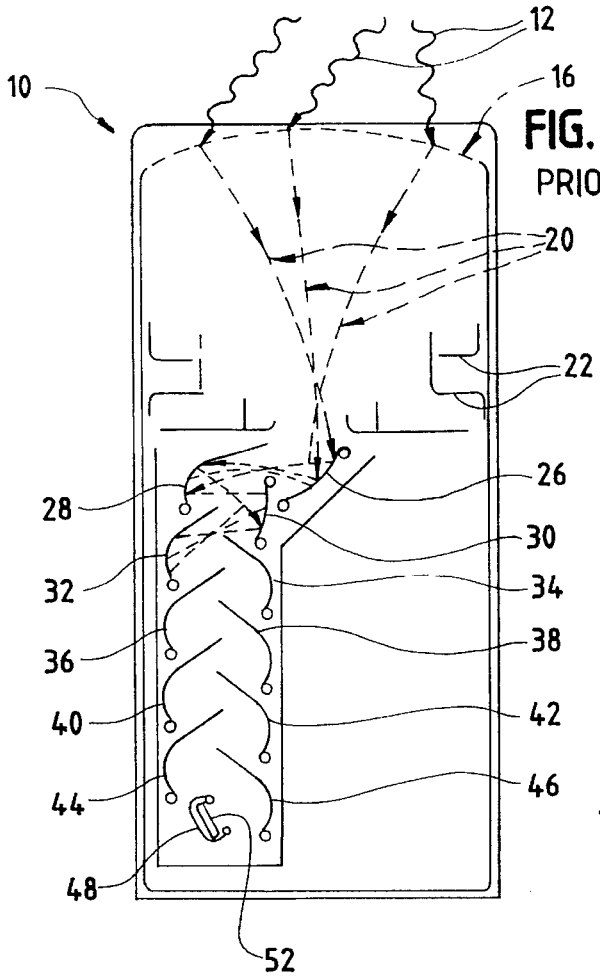
FIG. 1
PRIOR ART
FIG. 2
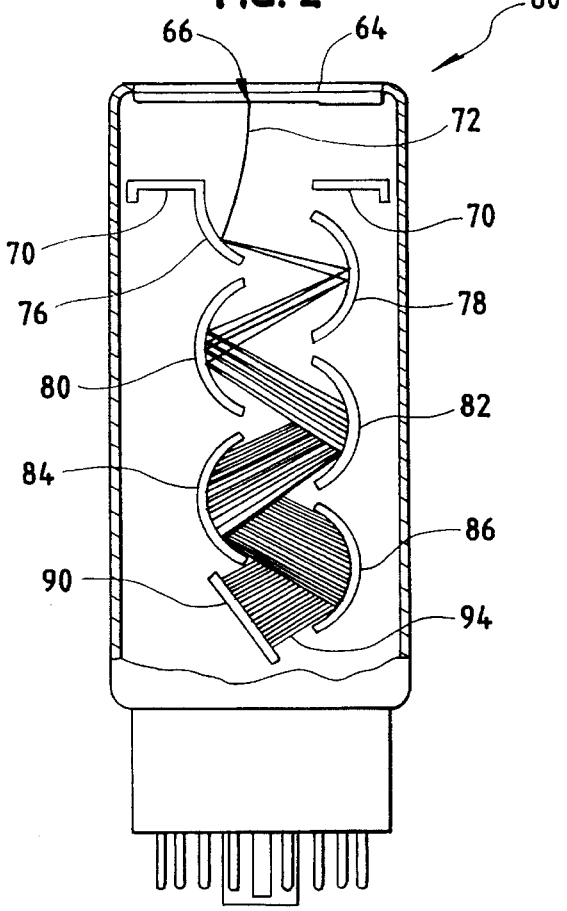

CVD DIAMOND- AS RECEIVED
100 NM CSI ON MO
CVD DIAMOND COATED WITH 10 NM CSI

DIAMOND FILMS TREATED WITH ALKALI-HALIDES

This invention was made with Government Support under Contract No. DE-AC02-76CH03000 awarded by the U.S. Department of Energy. The Government has certain rights in the invention.

FIELD OF THE INVENTION

This invention relates generally to secondary electron emitting surfaces designed for the amplification of electron signals, and more particularly concerns diamond films as a secondary electron emitter, and more particularly concerns diamond films coated or treated with alkali-halide.

BACKGROUND OF THE INVENTION

Detection of incident light or photons plays a great role in the analyses and examination of many different materials in numerous different applications. For example, vacuum electronic devices have been used to detect and measure emitted photons. Such vacuum electronic devices generally utilize electron amplification to generate an electron emission sufficient to provide a signal that may be accurately measured. The electron amplification may be accomplished by a means of secondary electron emission.

The secondary electron emission yield has been investigated for a wide variety of materials. A material's secondary electron emission yield quantifies the performance of a material's ability to emit electrons in response to incident electrons and is defined as the ratio of emitted electrons to incident electrons.

For most metals the emission yield is generally limited to maximum values between 1 and 2. That is, between 1 and 2 electrons are emitted by the metal in response to 1 incident electron impinging on the metal surface. The yield can be much higher for oxides, glasses, and semiconductors, but typically electron emission cannot be sustained from these surfaces because of their low electrical conductivity. A further drawback is that metals, oxides, glasses, and semiconductors tend to polarize as a result of secondary emission and eventually repel incident electrons or, in the alternative, suffer electrical breakdown. Thus, it is difficult to measure the secondary emission yield from metals, oxides, glasses, and semiconductors and they are of limited engineering service.

The use of an untreated diamond film deposited on a metal substrate has proven to be a promising secondary electron emitter. Metal surfaces with a diamond film can increase electron amplification by a factor of more than 10. In fact, measurements at the NASA Louis Research Center indicate that the secondary electron yield for a diamond film deposited on the metal substrate can be as high as 45. Additionally, the diamond film is especially useful because it is conductive and able to sustain electron emission without accumulating a charge. The diamond film is also a robust surface that is extremely resistant to abrasion and heat.

One disadvantage of using a diamond film as a secondary electron emitter is that the emission deteriorates under electron bombardment. In order to restore the emitting quality of the diamond film, the diamond film must be exposed to hydrogen gas or it must be annealed in a vacuum. A second disadvantage is that the diamond films that have been subjected to ion sputtering exhibit properties that are similar to carbon, that is, a secondary yield is typically less than 1.

Studies indicate that the above disadvantages can be overcome, but in turn create other disadvantages. Specifically, diamond films exhibit stable continuous emission when operated in a continuous hydrogen atmosphere. However, the presence of gas in some classes of electronic devices is highly undesirable because the gas may become a source of ions that will damage the diamond film surface.

SUMMARY OF THE INVENTION

The aforementioned problems related to low secondary electron emission yield, surface degradation, emission deterioration, and special handling considerations are solved by the present invention.

The secondary electron emitter of the present invention utilizes diamond (usually chemical vapor deposition (CVD)) films which are known to emit secondary electrons when energetic electrons impinge on the front surface of the diamond films. The diamond films of the present invention are coated with an alkali-halide selected from the group consisting of CsI, CsF, KCl, and NACl. The alkali-halides provides the CVD diamond film with a stability and electron-emitting consistency mot previously encountered. The alkali-halide coated diamond film has a secondary-electron yield many times higher than other air-stable secondary electron emitters. Typical applications for the present invention include the production of high electron yield diodes in photomultiplier tubers.

Accordingly, it is an object of the invention to provide a secondary electron emitter with a secondary electron emission yield greater than that of the emitters of the prior art.

A further object of the invention is to provide a secondary electron emitter that is air stable and easier to handle.

Another object of the invention is to provide a diamond film for use as a secondary electron emitter.

It is still a further object of the invention to provide a diamond film stabilized with an alkali-halide.

A further object of the invention provides a diamond film stabilized by an alkali-halide that does not degrade or deteriorate over time as result of its secondary electron emission.

Other objects and advantages of the invention will become apparent upon reading the following detailed description and appended claims, and upon reference to the accompanying drawings.

BRIEF DESCRIPTION OF THE DRAWINGS

FIG. 1 is a cross-sectional view of a typical photomultiplier tube.

FIG. 2 is cross-sectional view of an alternative embodiment of a typical photomultiplier tube illustrating the increased electron emission associated with a secondary electron emitter.

DETAILED DESCRIPTION OF THE INVENTION

Figure 3:
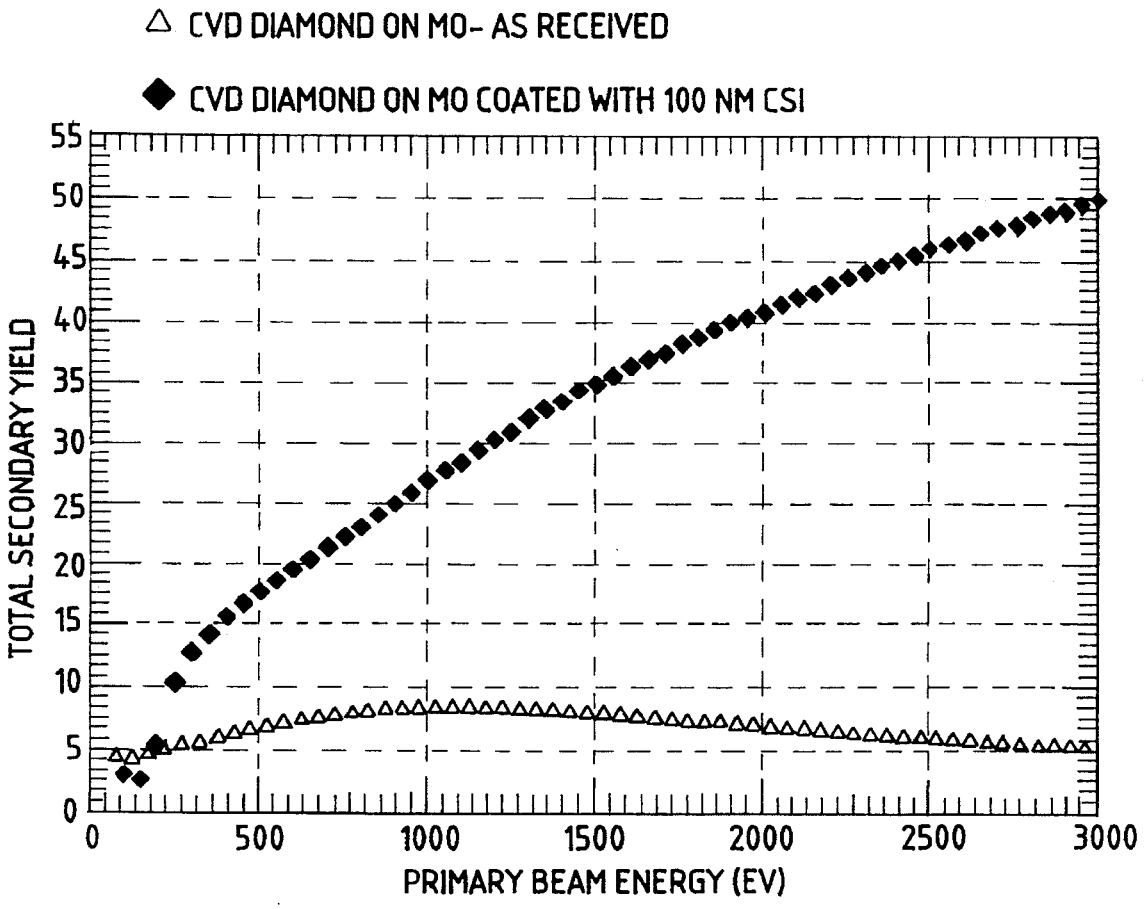
FIG. 3 is a graph showing the total secondary yield of the CVD diamond as a function of primary beam energy.

FIG. 1 is a cross-sectional view of a typical photomultiplier tube 10. A photomultiplier tube 10 collects incident light and converts the light into measurable quantities of secondary electrons order to enable characterization and measurement of the incident light. Accordingly, a photomultiplier tube represents an ideal application for the secondary electron emitter of the present invention. The following discussion of the operation of a typical photomultiplier tube 10 demonstrates a possible application of the present invention in such tubes and in other analogous applications.

Typically, incident light 12 impinges on the photocathode 16. The photocathode 16 converts the incident light 12 into photoelectrons through the photoelectric effect of the photocathode 16. The photoelectrons follow typical photoelectron trajectories 20 which are defined by the focusing electrodes 22. That is, the focusing electrodes 22 carry a charge to define the trajectory of the photoelectrons and to focus them toward the first dynode 26.

A photomultiplier with an enhanced first dynode 26 to achieve a secondary electron emission yield greater than the remaining dynodes has been used in the prior art. Tubes with such an arrangement are known as "quanticon" photomultiplier tubes. Such quanticon tubes had been undesirable in the prior art due to the added expense and handling difficulties associated with the enhanced secondary electron emitters of the prior art and used as the first dynode. Although the present invention may be utilized as the secondary electron emitter of the first dynode in such "quanticon" tubes, it is more likely that the emitter of the present invention will be used as the emitter for all of a photomultiplier tube's dynodes because the emitter of the present invention combines enhanced yield with decreased expense and handling considerations.

The secondary electrons emitted from the first dynode 26 then travel to the second dynode 28 where additional electron multiplication occurs. This electron multiplication continues from the third dynode 30 through to the 12th dynode 48. Each of the intermediate dynodes 32, 34, 36, 38, 40, 42, and 46 add to the electron multiplication effect. The anode 52 collects and detects the secondary electrons and is typically connected to a device that converts the measured value of secondary electrons to a corresponding value for the quantity of incident light that originally impinged the photocathode 16. FIG. 2 is a cross-sectional view of an alternate embodiment of a photomultiplier tube 60. The photomultiplier tube 60 includes a photocathode 64 to convert incident light 66 into photoelectrons. The focusing electrodes 70 define the photoelectron trajectory 72 and focus the photoelectron upon the first dynode 76. The electron multiplication effect continues through the remaining dynodes 78, 80, 84, and 86. Finally, anode 90 receives a greatly enhanced signal which can be translated to quantify the amount of incident light 66 that originally impinged on the photocathode 64.

FIG. 2 fully reflects the desired electron multiplication effect of the increasing density of secondary electrons by illustrating the increasing number of secondary electron trajectories 72. The illustrated secondary electron trajectories 72 continuously increase in number between the dynodes 76, 78, 80, 84 and 86 and result in a blackened secondary electron beam 94 that is collected at anode 90.

FIGS. 1 and 2 illustrate typical uses of the present invention. The emitters of the present invention, however, may be utilized in any number of applications where a electron multiplication effect is desired.

The secondary electron emitter of the present invention consists of three components: (i) a conducting substrate; (ii) a diamond film; and (iii) an alkali-halide treatment of or coating on the diamond film. Typically, the conducting substrate will be either molybdenum or silicon. These substrates are well known in the art and are typically used in similar applications. The preferred diamond films for use in the present invention are polycrystalline and are grown by microwave plasma and hot filament assisted chemical vapor deposition (CVD). However, diamond films (both amorphous and polycrystalline) created through other techniques, such as laser sputtering, are also contemplated. The growth of polycrystalline diamond films by microwave plasma in hot filament assisted chemical vapor deposition is well known in the art and not discussed here.

Figure 5:
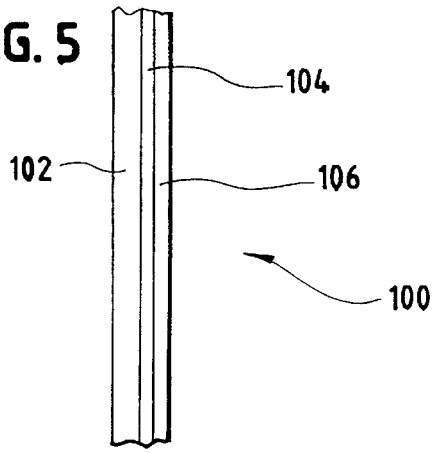
FIG. 5 is a schematic diagram of one embodiment of the secondary electron emitter of the present invention, which consists of a conducting substrate, a diamond film and an alkali-halide film.

FIG. 5 is a schematic depiction of one embodiment of a secondary electron emitter 100, which consists of a conducting substrate 102, a diamond film 104 and an alkali-halide film 106.

The alkali-halide films, preferably having a thickness within the range of 10 to 100 nm are vapor deposited onto the diamond films in a high vacuum chamber with a base pressure of $1.0\times10^{-7}$ torr. The thickness of the alkali-halide film was controlled using a quartz crystal monitor. Thick alkali-halide film must be avoided due to their insulating properties. Alkali-halide vapor deposition onto a substrate in a high vacuum chamber is well known in the art and not discussed here.

The alkali-halide films that have been found to provide the beneficial emitting results include CsI, KCl, NaCl, and CsF. The results related to these alkali-halides suggests that any alkali-halide nay provide a similar effect and should be investigated.

EXAMPLE

Secondary electron emission measurements were made on each CVD diamond film target before and after the alkali-halide deposition. All secondary electron emission measurements were made in an ultra-high vacuum chamber with a base pressure of $1.0\times10^{-10}$ torr. The experimental set-up has been described extensively in G. T. Mearini, I. L. Krainsky,, and J. A. Dayton, Jr., Surf. and Int. Anal., 21 (2), (1994) 138–143. Simply stated experimental set-up simply permits the striking of the surface with an electron of a known energy and the measurement of the secondary electrons produced.

Total secondary yield vs. primary beam energy was measured from each alkali-halide sample with the primary beam energy ranging from 100 to 3000 eV in 50 eV increments. The total secondary yield vs. time was measured from the untreated and CsI coated diamond films at room temperature and at temperatures up to 160° C. The targets were exposed to the electron beam at current densities of 1.5 to 50.0 mA/cm$^2$, in a primary beam energy range of 1.0 to 1.5 keV, for durations of 6 to 170 hours. The current density and primary beam energy were held constant during each exposure. The fluency dependence of secondary electron emission properties $\delta$ was studied by plotting the data vs. The product of the primary current density and the time of exposure. Total secondary yield vs. time and energy was measured from CsI and KCl films on Mo substrates, in the same thickness range as coated on the diamond films, for comparison. Measurement of $\delta$ (secondary electron emission properties) vs. time were also made from CVD diamond films coated with CsF, KCl, and NaCl.

Maximum total secondary yields from the as-received, uncoated targets ranged from 6 to 12 and occurred at a primary beam energy of 1 keV. FIG. 3 shows the total secondary yield vs. primary beam energy from a representative CVD diamond target before and after a 10 nm CsI coating was deposited. For the coated sample, the data were collected after the surface was activated by electron exposure. Grids were placed above the target surface to eliminate space charge effects. The maximum value of δ was measured from a 100 nm thick pure CsI coating on Mo and yielded a δ value of 9 at 1500 eV.

Figure 4:
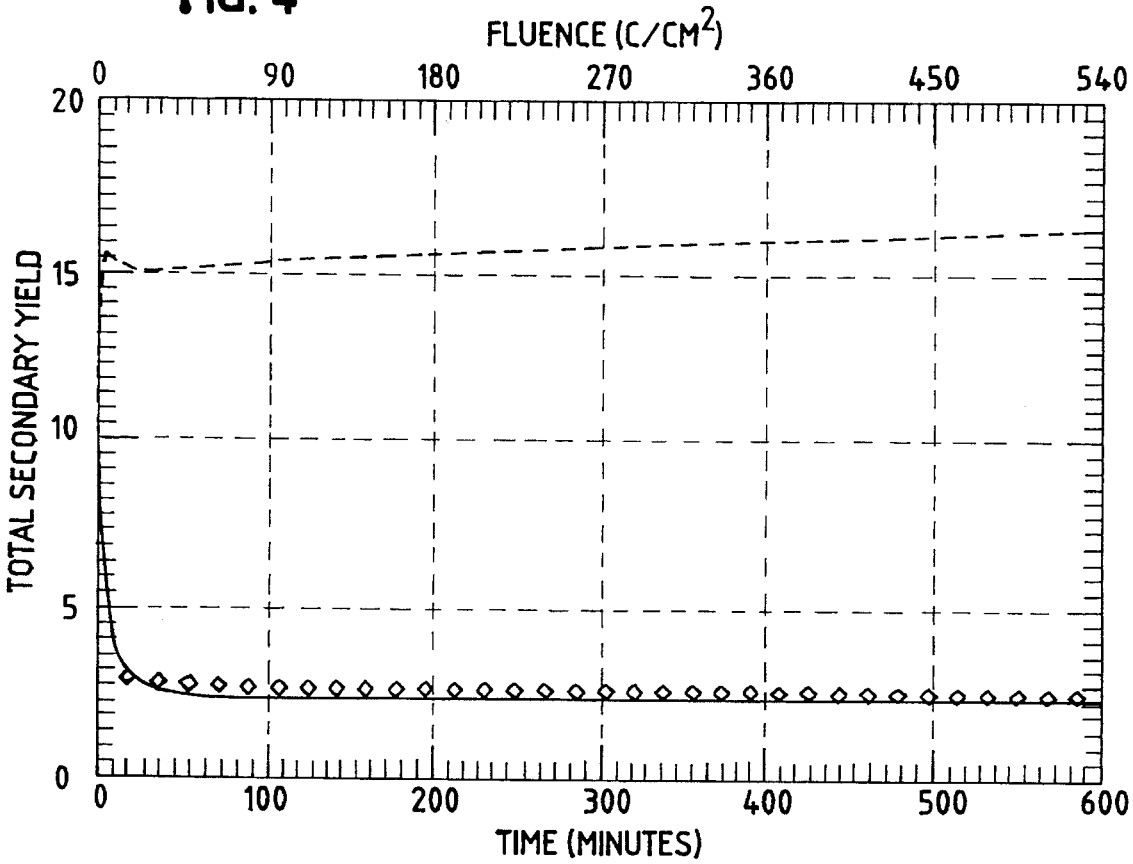
FIG. 4 is a graph showing the total secondary yield of various secondary electron emitters as a function of time.

FIG. 4 shows the total secondary yield vs. time from a 100 nm thick CsI film on Mo, and from a diamond target before and after a 10 nm thick CsI film was deposited. The data were collected while the samples were under continuous electron bombardment. CsI coatings on both diamond and Mo were initially unstable under exposure to the electron beam. All data were collected using a primary current density of 15 $mA/cm^2$ at 1500 eV. The total secondary yield from the uncoated (hydrogen terminated) diamond films typically degraded to a value of approximately 3 due to electron beam induced desorption of hydrogen. δ from the CsI and KCl coated films invariably degraded from the as received values of 8–12 to values as low as 1.5 at the onset of electron exposure, then rose above the initial values after fluences on the order of 10 $C/cm^2$. δ for the KCl on the Mo substrate was similar to that for CsI on the Mo substrate and it is expected that δ for other alkali-halides would mirror those results.

The stable secondary emission from the CsI coated samples showed no signs of degradation after they were initially activated. δ from the coated sample shown in FIG. 4 increased steadily until it stabilized at a value of 22 after 67 hours. The yield remained stable for the next 103 hours, at which time the test was terminated. All CsI coated samples showed the same stable emission, independent of the initial thickness of the CsI coating. This is conclusive proof that the CsI on diamond gives far superior results to the combined performance of the CsI and the diamond separately.

Targets coated with KCl, NACl, and CsF showed the same stable secondary electron emission, with absolute yields ranging from 12 to 40 depending on the specific target. These electron beam activated-alkali terminated (EBAAT) CVD diamond films represent a material capable of sustaining very high secondary yields under practical electron device operating conditions.

While a particular embodiment of the invention has been described and illustrated, it will be understood, of course, that the invention is not limited thereto since modifications may be made those skilled in the art, particularly in light the foregoing teachings. It is, therefore, contemplated by the appended claims to cover any such modifications as incorporate those features which constitute the essential features of these improvements within the true spirit and the scope of the invention.

What is claimed:

1. A secondary electron emitter comprising a substrate, a diamond film on the substrate, and an alkali halide film on the diamond film.

2. The secondary electron emitter of claim 1 wherein the substrate is molybdenum.

3. The secondary electron emitter of claim 1 wherein the substrate is silicon.

4. The secondary electron emitter of claim 1 wherein the diamond film is deposited on the substrate by chemical vapor deposition.

5. The secondary electron emitter of claim 4 wherein the diamond film has a thickness of between 1,000 and 10,000 nm.

6. The secondary electron emitter of claim 4 wherein the diamond film has a thickness of 10,000 nm.

7. The secondary electron emitter of claim 1 wherein the alkali-halide is selected from the group consisting of CsI, KCl, CsF, and NaCl.

8. The secondary electron emitter of claim 7 wherein the alkali-halide is CsI.

9. The secondary electron emitter of claim 8 wherein the CsI film thickness is 100 nm.

10. The secondary electron emitter of claim 1 wherein the alkali-halide film thickness is between 10 and 100 nm.

11. An improved photomultiplier tube having a photocathode, at least one dynode having a secondary electron emitter, and an anode, wherein the improvement comprises a secondary electron emitter comprising a substrate, a diamond film on the substrate, and an alkali-halide film the diamond film.

* * * * *

UNITED STATES PATENT AND TRADEMARK OFFICE

CERTIFICATE OF CORRECTION

PATENT NO. : 5,619,091

DATED : April 8, 1997

INVENTOR(S) : Anderson, et al

It is certified that error appears in the above-identified patent and that said Letters Patent is hereby corrected as shown below:

Col. 1, line 15, "alkali-halide" should read -- alkali - halides--.

Col. 2, line 22, "mot" should read --not--.

Col. 2, line 27, "tubers" should read --tubes--.

Col. 3, line 2, after the word "electrons", insert the word --in--.

Col. 3, line 36, after the number "42", insert --44--.

Col. 4, line 30, "nay" should read --may--.

Col. 4, line 58, "The" should read --the--.

Col. 5, line 39, after the word "CsF", insert the word --all--.

UNITED STATES PATENT AND TRADEMARK OFFICE

CERTIFICATE OF CORRECTION

PATENT NO. : 5,619,091

DATED : April 8, 1997

INVENTOR(S) : Anderson, et al

It is certified that error appears in the above-identified patent and that said Letters Patent is hereby corrected as shown below:

Col. 6, line 6, after the word "made", insert the word --by--.

Col. 6, line 6, after the word "light", insert the word --of--.

Col. 6, line 39, after the word "film" insert the word --on--.

Signed and Sealed this

Sixth Day of January, 1998

*Attest:*

*Attesting Officer*

Bruce Lehman

BRUCE LEHMAN

*Commissioner of Patents and Trademarks*